United States Patent [19]

Winterholler et al.

[11] Patent Number: 4,598,850

[45] Date of Patent: Jul. 8, 1986

[54] WEB THREADING ARRANGEMENT FOR THREADING A PAPER WEB THROUGH A ROTARY PRINTING MACHINE

[75] Inventors: Johann Winterholler, Friedberg; Josef Plantsch; Petra Fischer, both of Augsburg, all of Fed. Rep. of Germany

[73] Assignee: M.A.N.-Roland Druckmaschinen Aktiengesellschaft, Offenbach am Main, Fed. Rep. of Germany

[21] Appl. No.: 700,503

[22] Filed: Feb. 11, 1985

[30] Foreign Application Priority Data

Feb. 15, 1984 [DE] Fed. Rep. of Germany ..... 3405294

[51] Int. Cl.[4] ..... B65H 20/00

[52] U.S. Cl. ..... 226/92; 101/228

[58] Field of Search ..... 226/91, 92, 119, 197, 226/76, 86; 101/178-181, 219, 228; 34/56

[56] References Cited

U.S. PATENT DOCUMENTS

| | | | |
|---|---|---|---|
| 2,944,345 | 7/1960 | Faeber | 34/56 |
| 3,127,079 | 3/1964 | Allander | 226/92 |
| 3,995,553 | 12/1976 | Winterholler et al. | 101/228 |
| 4,111,122 | 9/1978 | Kutzner et al. | 101/228 |
| 4,187,968 | 2/1980 | Winterholler et al. | 226/92 |
| 4,370,927 | 2/1983 | Fischer | 101/228 |

*Primary Examiner*—Stanley N. Gilreath

*Attorney, Agent, or Firm*—Frishauf, Holtz, Goodman & Woodward

[57] ABSTRACT

To permit formation of a threading element as a closed-loop structure, while being capable of accommodating threading paths of different lengths, the threading element is formed as a sprocket chain which has a long return portion (1) in a return path, coupled to a driven sprocket wheel (2), and connecting portions (3, 4) of a length suitable for the respective threading paths (B, C), and selectively connectable with the return portion (1), to thereby form a closed loop with the selected connecting portion (3 or 4). Pneumatically operated pistons located on path selection switches (5, 6) push the last link of the return portion into engagement with a selected end of the connecting portion, for example by engaging a cross pin (26) in a slotted end link (22, 23; 24, 25) of the connecting portions. The system is entirely automatically controllable, and additional pneumatically operated pistons (7, 10; 8, 11; 9, 12) engage between the links of the link pairs of the respective return and connecting portions of the sprocket chain to hold the respective portions in position during switch-over of the terminal link and, after switch-over, to retain in position that one of the connecting portions which is not connected, for future use.

20 Claims, 4 Drawing Figures

WEB THREADING ARRANGEMENT FOR THREADING A PAPER WEB THROUGH A ROTARY PRINTING MACHINE

Reference to related patents, the disclosures of which are hereby incorporated by reference: U.S. Pat. No. 4,187,968 Winterholler et al, U.S. Pat. 3,127,079.

The present invention relates to a threading arrangement to thread a paper web through a rotary printing machine, and more particularly to a threading arrangement in which the paper can be threaded through selected different multiple paths in accordance with a desired alignment of the paper web with cylinders of the printing machine for selectively printing on the threaded paper web.

BACKGROUND

Various types of paper web theading systems are known, see for example German Patent No. 22 41 127, and the referenced U.S. Pats. Nos. 3,127,079 and 4,187,968, Winterholler et al, assigned to the assignee of this application. These, and other paper threading arrangements known in the industry, permit pulling a paper web on which printing is to be effected through the printing machine. The pulling path is determined by the setting of switches which control the path of a pulling element, around selected cylinders, or bypassing selected cylinders. In this manner, the paper web can be pulled through respective printing stations of the printing machine.

It is desirable that the pulling element be formed of an endless pulling cable, sprocket chain, or the like. The pulling force can be quite substantial, and when using a pulling element which has a finite end, a plurality of drive stations are necessary to move the pulling structure through the printing machine. Using an endless pulling element permits placement of only a single drive element in engagement with the endless cable or sprocket chain; otherwise, a single pullling element can move a cable or pulling element of a finite length only along a single path, by pulling or pushing the respective element.

It has previously been proposed to utilize a threading structure with a finite pulling element in form of a cable, in which the paper web is first secured to the pulling element and the cable is then engaged with motor. The cable is passed between two drums, one paying out cable and the other winding it up; this arrangement again requires two drive elements (see, for example, U.S. Pat. No. 3,127,079).

THE INVENTION

It is an object to provide a web threading arrangement for a printing machine in which an endless pulling element can be used by means of which a web to be threaded can be passed through a rotary printing machine along selected threading paths of, for example, different lengths. Preferably, only a single drive unit should be required to provide the necesary pulling force.

Briefly, the threading element comprises at least two separable elongated elements which have respective lengths to form an endless loop, between switches. The lengths of the separable elements are matched to the length of the desired threading paths. The respective separable elongated elements are formed with connections located at end portions of the separable elements, the connections permitting insertion of threading elements of selected different lengths in accordance with the desired threading path, and connected together to provide an endless threading element whose final length then will be matched to the selected path.

Preferably, the threading elements are sprocket chains which can be easily severed, and reconnected, as desired, in different lengths, for example by separable links similar to the connection of bicycle chains or "repair links" used in connection with bicycle chains; in accordance with a preferred feature of the invention, sprocket chain elements are provided which already have separable, selectively engageable and disengageable end links with hooks so that selected lengths of chain can be placed, as desired, and as required by the selected threading path. The switches preferably include holding elements to hold the end portions of the selected threaded elements, typically the sprocket chains, in position so that joining selected lengths of the sprocket chains together is facilitated since the respective sprocket chain lengths can be securely held within the machine itself at the switches.

DRAWINGS

Figure 1:
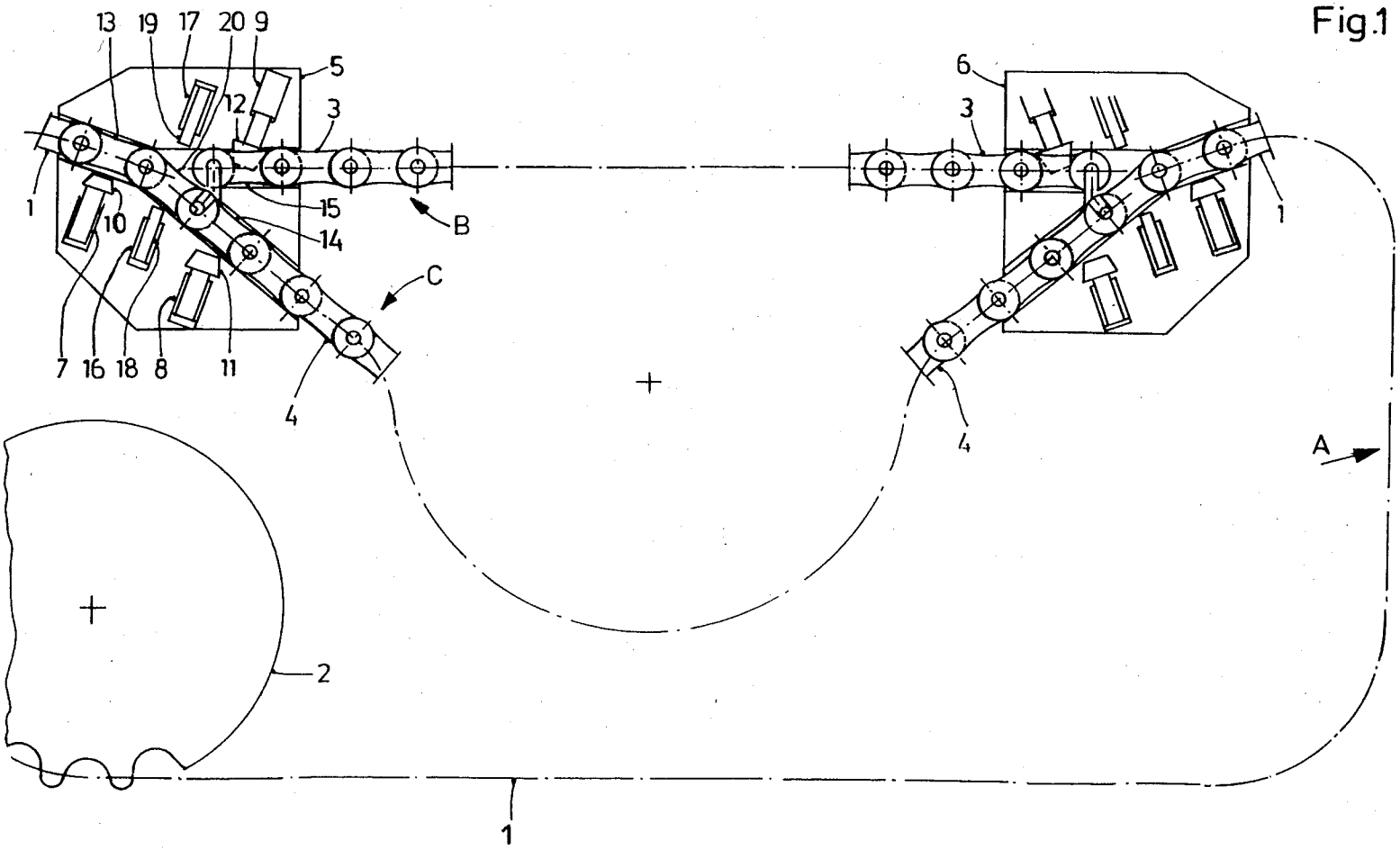
FIG. 1 is a side view, partly schematic, illustrating the connection of different lengths of sprocket chains for selected threading paths.
Figure 3A:
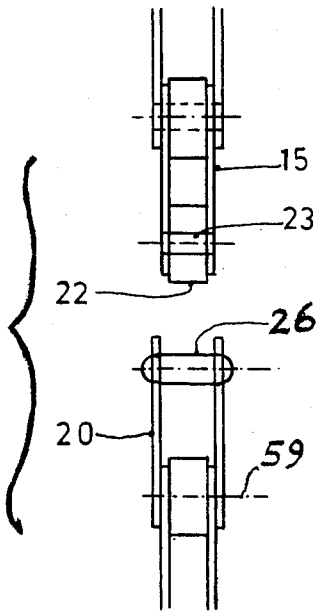
Figure 3B:
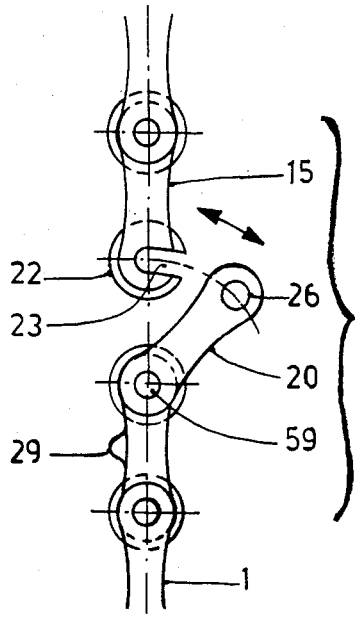

FIG. 3*a* is a top view of two sprocket chain elements adapted for connection together, and shown in unconnected, exploded representation; and FIG. 3*b* is a side view of two sprocket chain elements, and illustrating the connection in greater detail and to a scale larger than that of FIG. 1.

DETAILED DESCRIPTION

FIG. 1 is a side view illustrating the threading arrangement by means of which a web on which printing is to be effected can be pulled through a printing machine. The printing machine threading path extends along two different possible paths, path B and path C. To connect the paths into an endless loop, a return path A is provided which extends over a drive element, shown as a sprocket 2 which is coupled to a suitable drive motor, not shown. The return path A is closed behind the sprocket 2 to a first switch 5. The return path is not shown in the drawing and can be in accordance with any desired arrangement. As a result, the selected path will be either B-A or C-A, in a closed-loop arrangement.

Each one of the two paths B and C has a respective sprocket chain element 3, 4, associated therewith. A sprocket chain element 1 closes the loop through path A, the sprocket chain element 1 being driven by the sprocket wheel 2. Rather than using a sprocket chain and sprocket wheel, other flexible pulling arrangements may be used, such as cables, ropes, or ribbons or tapes. Sprocket chains, however, are preferred since they are especially suitable for threading arrangements, and since they can be easily separated into sprocket chain elements, so that the length of the entire loop can be easily matched to the length of the respective pulling path, that is, path B or C; the respective threading elements, here the sprocket chains 3, 4, can be easily connected to the return portion of the sprocket chain element 1 if all the threading elements are formed as sprocket chains.

The direction of the respective path is determined by switches which switch the respective sprocket chain elements 3, 4 as desired, and further are capable of locking the respective chains in position. The switches 5, 6, of which two are necessary, can be constructed identically, and as shown in FIG. 1, can be the mirror images of each other. Since the switches 5, 6 will be identical, only switch 5 will be described in detail.

The switch 5 has three positioning cylinders 7, 8, 9 located thereon, one each being associated with the end portion of a sprocket chain element 1, 3, 4. More than three sprocket chain elements can be handled by the switch, for example there may be more switching positions for additional sprocket chain elements for coupling with element 1. The positioning cylinders 7, 8, 9 are fluid-controlled, preferably by pneumatic control. The positioning cylinders have pistons 10, 11, 12 which can be engaged with the last link pair of the sprocket chain elements, that is, the link pairs 13, 14, 15. The link pairs 15 are seen in FIGS. 3*a*, 3*b* in greater detail. The pistons 10, 11, 12 provide for exact holding of the ends of the sprocket chain elements 1, 3, 4, terminating in the switch 5. Additionally, the switching position is precisely predetermined by the respective pistons.

Preferably, switch-over arrangements in form of two fluid-pressure-operated cylinders 16, 17, preferably pneumatically operated cylinders, with projectable pistons 18, 19, push the respective last pair of links 20 of the element 1 terminating in the switch 5 towards the respective selected threading path B or C, that is, either upwardly, in counterclockwise direction, or downwardly, in clockwise direction. By movement of the respective pistons 18, 19, then, the end of the chain portion formed by sprocket chain element 1 can be readily coupled with the respective chain portion formed by sprocket chain element 3 in the path B or with the chain portion formed by sprocket chain element 4 in the path C within the switch structure 5, thus substantially facilitating the connection, as will be explained in detail below. A similar arrangement is, preferably, also provided in the switch 6. FIG. 1 shows that, thus, by coupling the selected sprocket chain element 3 or 4 with the sprocket chain element 1, in accordance with the selected threading path B or C, an endless drive system is obtained passing the sprocket wheel 2, which is formed by the return portion of sprocket chain element 1 in the return path A and the respective sprocket chain element 3 or 4 in the respective path B or path C. The lengths of the paths B and C preferably have a difference which is a multiple of the respective circumference of the cylinders about which the web is to be threaded, and used in the printing machine. The differences in path lengths may, however, also have other predetermined values, for example if a cylinder is only partially covered by a printing plate.

Figure 2:
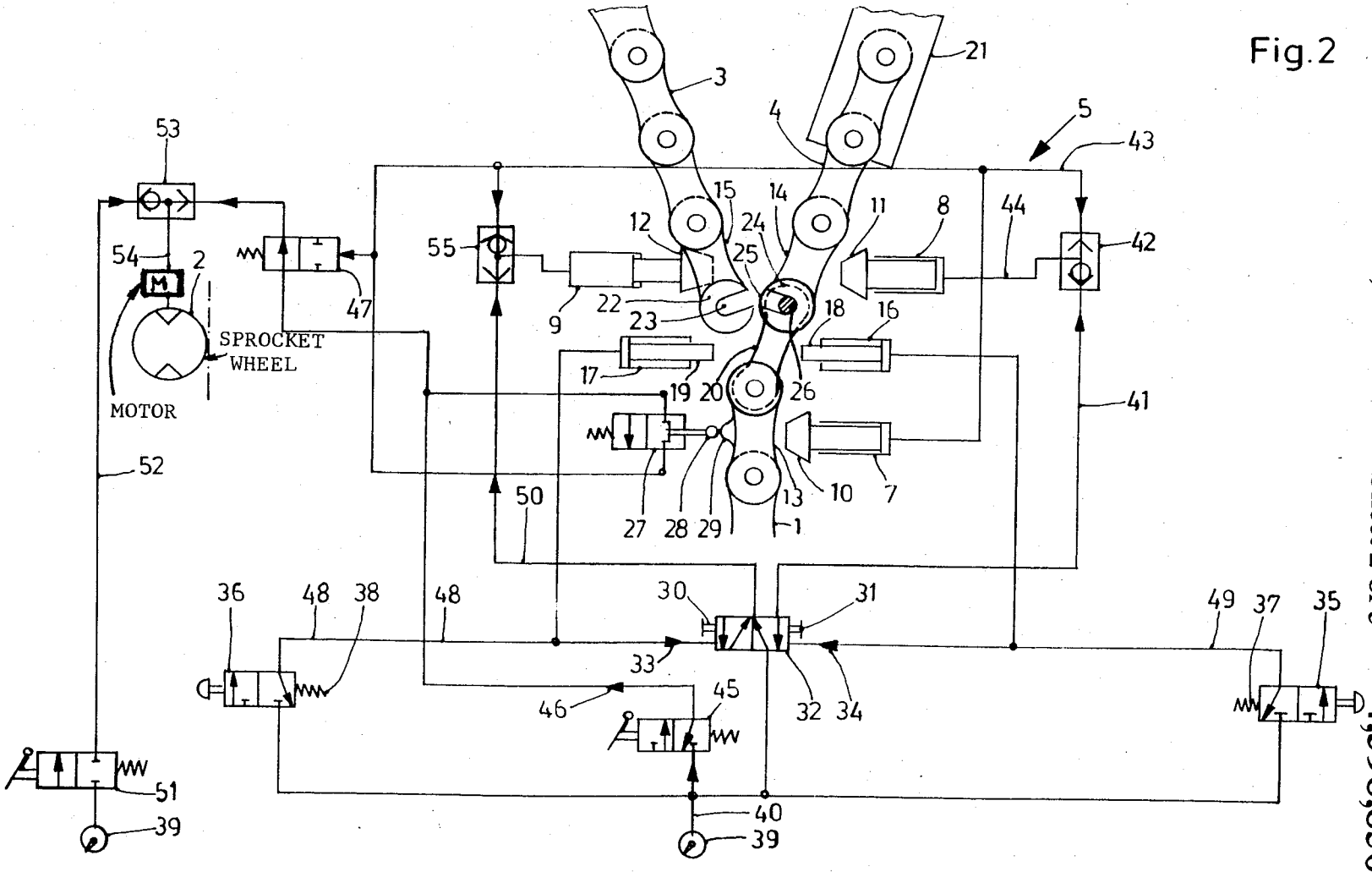
FIG. 2 is a detail view of a control arrangement for a switch, and also illustrating the connection arrangement.

FIG. 2 illustrates in greater detail the switch-over arrangement for switching the link pair 20, and to control the cylinders 16, 17 as well as the positioning cylinders 7, 8, 9. The switching arrangement is shown to be pneumatic, although other control forces, and control energy can be used.

Let it be assumed, first, that the pair of links 20 of the sprocket chain element 1 is to be coupled with a selected one of the sprocket chain elements 3 or 4. It is then necessary to move the respective last link of the chain element 1 which is in the switch 5 or 6. The link roller 22 of the chain element 3, and similarly the terminal link of the chain element 4, is formed with a slit, in which slit 23 in chain portion 3 is clearly visible; the slit of chain element 4, which is the one which is connected, is seen at 25. For precise and reliable guidance of the chain elements 1, 3, 4, it is desirable to place the respective chain link portions into guide ways 21 (FIG. 2) located laterally of the printing stations—not shown in the drawings—and of their cylinders, and placed along the respective threading paths B, C and along the return path A.

As is well known, a link chain is built up of a plurality of link pairs (see FIGS. 3*a* and 3*b*) at the ends of which rollers are located, retained on cross pins or cross bolts. As stated, the last of the rollers 22, 24 of the chain elements 3, 4 must be slit, so that the bolt 26 on the last link pair 20 of the chain 1 can be fitted by suitable operation of one of the transfer cylinders 16, 17 either in the slit 23 of the link 22 or in the slit 25 of the link 24.

It is frequently desirable that those chain elements which were previously connected together are brought into the switching position corresponding to the selected switching path before a desired change in the switching path can be effected, by reconnecting the return chain 1 with a chain element 3, or 4, respectively, in the switches 5, 6. To retain the respective chain elements in position, a chain positioning and securing arrangement 27, 28, 29 is provided which includes a pneumatically operated approach sensing switch in form of a valve 27, operated by a swtiching cam follower 28. The switching cam follower 28 is engaged by a bridge element or cam element 29 secured to the next-to-last link of the return chain element 1. The sprocket chain 2, controlled by a motor, is then driven by the motor as controlled in accordance with the requisite and desired switching program. Thus, when a desired chain position is reached, that is, when the cam bridge 29 engages the contact cam follower 28, the drive to the motor M (FIG. 2) driving the sprocket chain is disconnected.

The switching arrangement shown in FIG. 2 is illustrated based on entirely pneumatic operation. Two hand controls 30, 31 and a pneumatic two-way transfer valve 32 are provided. The transfer valve 32 has two automatic transfer switching inputs 33, 34 which are capable of setting the transfer valve 32 on either one of two possible switching states. The arrangement of FIG. 2 additionally includes two path selection valves 35, 36 which each have a return spring 37, 38, so that the switching valves 35, 36 remain in switched position only as long as they are operated by an operator, for example by hand.

A compressor, or other source of compressed air, connects compressed air to terminals 39, shown in FIG. 2. Compressed air is supplied over line 40 to the two selector valves 35, 36 and to the transfer valve 32. In the position shown, the transfer valve 32 provides a connection for compressed air to line 41 and thus a connection to the pneumatic OR-valve 42, the second input of which is connected to a line 43, and the output of which is connected over a line 44 to the positioning cylinder 8.

In addition to the foregoing, compressed air can pass from line 40 over the chain positioning switch 45 to a line 46 and then reaches the pneumatically operating approach switch 27 and further a switch 47.

The chain positioning switch 45 is operated in advance of a desired switching operation within the switches 5 and 6. In quiescent condition, the switch value 47 passes compressed air; the OR-gate 53 likewise passes compressed air, and hence the motor M, coupled to line 54 and associated with the sprocket wheel, is activated.

The motor, preferably, is a pneumatic motor.

The chain elements 1 and 4, or 1 and 3, respectively, which are connected together, thus will be moved by the motor unit until the bridge cam 29 reaches the valve 27 in the switch 5, and operates the switching contact 28. This causes opening of the valve 27 which, in turn, opens the switch valve 47, so that the motor M is disconnected. The chain stops and will assume the position in the switches 5, 6 required for changing-over within the switches.

If one of the hand-controlled valves 35, 36 is then operated, in dependence on the desired path B or C, the transfer valve 32 will switch over by energization of the line 33 or 34, respectively, so that either the positioning piston 8, via the OR-element 42 and line 44, is continuously blocked after the insertion step in a given path through the printing machine, and during switch-over, or, selectively, over line 50 and OR-gate 55, the positioning cylinder 9 will be continuously energized. Consequently, either the chain element 3 or the chain element 4—if it is not needed—can be fixed in position during the insertion step by the respective cylinder 8 or 9. In the position shown, the chain element 3 is fixed by the positioning cylinder 9—see FIGS. 1 and 2—since the piston 12 is projected to penetrate between the links of the link pair 15. The positioning cylinders 7, 8 are not activated since, for the desired insertion path C, the chain elements 1 and 4 are needed, rather than the chain elements 1 and 3. Thus, the chain elements 1 and 4 may not be pinched by the pistons 10, 11.

Change-over of the link pair 20 from alignment with the chain element 3 to alignment with the chain element 4 and hence insertion of the bolt 26 in the slit 25 of the roller 24 and withdrawal from the slit 23 of the roller 22 in chain element 3 is obtained upon momentary operation of the valve 36 by activating the switch-over cylinder 17. Conversely, to move the last link 20 in the other position, the switch 35 is momentarily operated, thus energizing the cylinder 16.

In the example selected, and preferably, all these positioning cylinders 7, 8, 9 are also energized upon switch-over of the link pair 20, and hence transfer of the position of the bolt 26, to insure reliable engagement and positive switching, and to retain all three chain elements 1, 3, 4 in the switch 5. Of course, a similar operation occurs in the switch 6, with respect to the desired switching position. Retention of the chains by the positioning cylinders 7, 8, 9 is effected by line 43 and the OR-elements 42, 55, coupled to the respective cylinders 8 and 9, and a direct connection with the cylinder 7. Upon operation of the switch 45, line 43 is energized with the respective compressed air supply over the closed approach switch 27. Thus, pistons 10, 11, 12 operable in cylinders 7, 8, 9, respectively, insure retention of the respective sprocket chain elements. Upon termination of movement of the link pair 20, and thus engagement of the desired chain 1 and 4, as shown—or 1 and 3, in a reverse change-over—an endless insertion element is formed. As noted, either one of the positioning cylinders 8 or 9 will remain energized via the switch-over valve 42 over the respectively associated OR-element 42 or 55 during the subsequent insertion procedure for a web. Thus, the chain element which is not necessary, that is, either chain element 3 or 4, will be retained in the switch 5 and 6, respectively.

After attaching the web to the attachment element, the operating switch can then be energized so that, over line 52 and the OR-element 53, and line 54, the drive motor M will receive compressed air through line 45 to drive the sprocket wheel 2. Preferably, the web to be pulled in is coupled to the chain element 1 since, in such a case, only a single attachment hook—not shown and of any suitable construction, for example as disclosed in the referenced patents, is required.

FIGS. 3*a* and 3*b* show the details of the interconnection of the chain elements. The cylinders 16 or 17, respectively, located to the left or the right of the link pairs 22 to be switched, cause a pivoting movement of the link pair about bolt 59 (FIG. 3*b*) so that the bolt 26 can slip free of jolts or jams into the slit 23 of the roller 22 (FIG. 3*b*). It may be desirable to add a well-known snap connection in order to prevent undesired slip-out of the bolt 26 from the slit 23, or the slit 25, respectively, in passage of the chain. This may not be necessary in most installations, however, since the chain elements 1, 3, 4 are guided in guide tracks 21 and, in operation, the motor M provides continuous tension on the interconnected links of the sprocket chain. Thus, generally, the danger of undesired slip-out of the bolt 26 from the respective slits 23 or 25 is remote. Any well-known arrangement, such as is customary in connection with bicycle chains, for example, may be used.

Various changes and modifications may be made within the scope of the inventive concept.

We claim:

1. Web threading arrangement for threading a paper web through a rotary printing machine along a selected one of a plurality of parallel or shunt paths (B, C) having a threading means (1, 3, 4);

path direction switches (5, 6) for guiding the threading means in a selected path in accordance with the setting of the switches, and wherein, in accordance with the invention, the threading means comprises at least two separable elongated elements (1, 3, 4) having respective lengths to form an endless loop between the switches (5, 6), the lengths of the separable elements being matched to the length of the desired selected threading path;

selectively engageable and separable connection means (20, 21, 22, 23, 24, 25; 59) located at the end portions of the separable threading elements for selectively connecting selected elements together in accordance with the length of the selected path, and to provide an endless combined threading means whose length is matched to the selected path and a return path (A);

and a drive means (M, 2) in engagement with said thus-formed endless threading means.

2. Arrangement according to claim 1, wherein said threading means and the separable elongated elements thereof (1, 3, 4) comprises sprocket chains;

and wherein the drive means comprises a sprocket wheel (2) engageable with the threading means in the return path (A) thereof.

3. Arrangement according to claim 2, wherein the switches (5, 6) include a first portion to position a first threading element (1) adapted for movement in the return path (A);

positioning means (17, 18) engageable with a terminal link (20) of said sprocket chain to move said terminal link in the switch in accordance with a selected threading path (B, or C);

and the selectively engageable connection means comprises a receiving link portion (22, 23; 24, 25) on a second and a third elongated separable threading element (3, 4), respectively, and selectively engageable with the terminal link of the first elongated element in accordance with the selected position thereof as determined by said positioning means.

4. Arrangement according to claim 3, wherein the positioning means comprises plunger means (18, 19) engageable with the terminal link of the first elongated threading element (1) and pivoting the first elongated threading element in a direction for engagement with the receiving link portion of the selected second or third threading element (3, 4) for movement in the selected path (B, C).

5. Arrangement according to claim 3, further comprising path element positioning means positioned for retaining the second and third separable sprocket chain elements in position in the respective switches (5, 6) at predetermined locations thereof.

6. Arrangement according to claim 1, further comprising locking means (11, 12) locking a separable elongated threading element (3, 4) which is not engaged by the selectively engageable connection means with another separable element in position in the switches to retain said not-engaged separable element in place in the apparatus.

7. Arrangement according to claim 5, wherein said path element positioning means are lockable in position to retain a separable elongated chain element and not engaged by the separable connection means in position in the switches (5, 6) to retain said not-engaged element in place in said arrangement.

8. Arrangement according to claim 1, wherein the switching (5, 6) include holding means (7, 8) for holding the end portions of the separable elongated elements in position to permit selective engagement of the separable connection means in accordance with the length of a selected path.

9. Arrangement according to claim 1, wherein at least three separable elongated elements are provided, one of said elements (1) forming a return element to close a loop in combination with another one (3 or 4) of said elements;

a locating means (29) is provided at a predetermined fixed position on said return element, and at least one of the switches includes a sensing element (27, 28), responsive to said locating element and providing an output signal upon sensing the presence of said locating element;

and means for controlling operation of said drive means (M, 2) as a function of a sensed position of said locating means with respect to a predetermined position of said sensing element.

10. Arrangement according to claim 9, wherein the threading means comprises a link sprocket chain;

said locating means comprises a special link having a characteristic differentiating said special link from all other links of the sprocket chain;

and the sensing element includes a position sensing switch responsive to said characteristic and coupled to said drive means (M, 2) to disconnect drive operation thereof and stop the sprocket chain.

11. Arrangement according to claim 6, further including an energy transfer switch (32) selectively applying operating energy to the respective path element positioning means (7, 8, 9) to selectively operate the path element positioning for retention of a selected separable elongated threading element in position in the switches (5, 6).

12. Arrangement according to claim 11, further comprising selectively operable control switches (35, 36) applying operating energy to said energy transfer switch for controlling the respective path element positioning means.

13. Arrangement according to claim 3, further including selectively operable control switches (35, 36) directly controlling the positioning means (17, 18) for control of the position of the terminal link in accordance with the selected threading path (B or C).

14. Arrangement according to claim 11, wherein at least three separable elongated elements are provided, one of said elements (1) forming a return element to close a loop in combination with another one (3 or 4) of said elements;

a locating means (29) is provided at a predetermined fixed position on said return element, and at least one of the switches includes a sensing element (27, 28), responsive to said locating element and providing an output signal upon sensing the prsence of said locating element;

and means for controlling operation of said drive means (M, 2) as a function of a sensed position of said locating means with respect to a predetermined position of said sensing element, further including OR function elements (42, 55) receiving operating energy, selectively, from said energy transfer switch (32) or the sensing element (27).

15. Arrangement according to claim 3, wherein said positioning means (17, 18) for placing the terminal link in a selected threading path (B, C) comprise pressure-fluid-operated positioning means.

16. Arrangement according to claim 5, wherein said path element positioning means (7, 8, 9) comprise pressure-fluid-operated positioning means.

17. Arrangement according to claim 14, wherein said operating energy comprises pressurized fluid;

said energy transfer switch comprises a transfer valve;

and said OR-function elements comprise pressure fluid logic elements (42, 55).

18. Arrangement according to claim 17, wherein said pressurized fluid comprises compressed air.

19. Arrangement according to claim 15, wherein said pressure-fluid-operated positioning means (17, 18) comprises pneumatic piston-cylinder combinations.

20. Arrangement according to claim 16, wherein said pressure-fluid-operated path element positioning means (7, 8, 9) comprises compressed air piston-cylinder combinations.

* * * * *